US008847774B1

(12) United States Patent
Gronneberg

(10) Patent No.: US 8,847,774 B1
(45) Date of Patent: Sep. 30, 2014

(54) INVISIBLE BARRIER RECHARGEABLE BATTERY ASSEMBLY

(76) Inventor: Jeffrey Bryan Gronneberg, Prior Lake, MN (US)

( * ) Notice: Subject to any disclaimer, the term of this patent is extended or adjusted under 35 U.S.C. 154(b) by 302 days.

(21) Appl. No.: 13/443,921

(22) Filed: Apr. 11, 2012

Related U.S. Application Data

(63) Continuation-in-part of application No. 13/313,068, filed on Dec. 7, 2011, now abandoned.

(51) Int. Cl.
*G08B 21/00* (2006.01)

(52) U.S. Cl.
USPC ..... 340/636.2; 340/636.1; 324/425

(58) Field of Classification Search
CPC combination set(s) only.
See application file for complete search history.

(56) References Cited

U.S. PATENT DOCUMENTS

| | | | | |
|---|---|---|---|---|
| 5,381,298 | A * | 1/1995 | Shaw et al. | 361/232 |
| 5,476,729 | A * | 12/1995 | Miller et al. | 429/1 |
| 6,002,236 | A * | 12/1999 | Trant et al. | 320/114 |
| 6,263,601 | B1 * | 7/2001 | Emert | 40/564 |
| 2004/0008116 | A1 * | 1/2004 | Goehring | 340/573.1 |
| 2008/0305387 | A1 * | 12/2008 | Murray et al. | 429/100 |

* cited by examiner

*Primary Examiner* — Travis Hunnings
(74) *Attorney, Agent, or Firm* — Dave Lingbeck

(57) ABSTRACT

An invisible fence rechargeable battery assembly for dramatically reducing homeowner's yearly invisible fence operating costs and reducing disposal of non-rechargeable batteries. The invisible fence rechargeable battery assembly includes a battery holder assembly including a battery holder having an open end and a closed end and also includes a battery pack being removably disposed in the battery holder and including a battery, and also including contacts being in communication with the battery, and a circuit module being in communication with the battery and at least one of the contacts, wherein the battery pack includes battery terminals.

19 Claims, 4 Drawing Sheets

INVISIBLE BARRIER RECHARGEABLE BATTERY ASSEMBLY

CROSS-REFERENCE TO RELATED APPLICATIONS

The present application is a continuation in part of U.S. application Ser. No. 13/313,068, filed on Dec. 7, 2011 now abandoned, the disclosure of which is expressly incorporated by reference herein in its entirety.

BACKGROUND OF THE INVENTION

1. Field of the Invention

The present invention relates to battery packs and more particularly pertains to a new invisible fence rechargeable battery assembly for dramatically reducing homeowner's yearly invisible fence operating costs and reducing disposal of non-rechargeable batteries.

2. Description of the Prior Art

The use of battery packs is known in the prior art. More specifically, battery packs heretofore devised and utilized are known to consist basically of familiar, expected and obvious structural configurations, notwithstanding the myriad of designs encompassed by the crowded prior art which have been developed for the fulfillment of countless objectives and requirements.

One prior art includes a battery pack assembly being removably inserted into a receptacle on a housing of an electronic receiver. The battery pack assembly supplies power to the electronic receiver. The receptacle for the battery pack has internal guide grooves and detents along the guide grooves. The battery pack has lugs which slide within the guide grooves to guide the battery pack into position within the receptacle. The detents cooperate with the movement of the lugs to lock the battery pack in position within the receptacle housing. A spring contained within the battery pack biases the battery pack relative to the receptacle to prevent the battery pack from inadvertently disengaging from the housing.

Another prior art includes a battery pack assembly configured to be removably inserted into a receptacle of an electronic device, comprising a battery housing having an open end and a generally closed opposite end having an opening therethrough with the battery housing being configured to receive a battery having a pair of opposite terminals therein through the open end. A first contact is mounted within the housing and configured to electrically contact one terminal of the battery and provide electrical contact with the one terminal of the battery from outside the battery housing. A flexible second contact includes a spring member mounted within the housing and being exposed through the opening with the second contact being configured to electrically contact the opposite terminal of the battery and provide electrical contact with the opposite terminal of the battery from outside the battery housing. The second contact is further configured to bias the one terminal of the battery into electrical contact with the first contact. A cap member is configured to cover the open end of the battery housing.

While these devices fulfill their respective, particular objectives and requirements, the aforementioned patents do not disclose a new invisible fence rechargeable battery assembly.

SUMMARY OF THE INVENTION

The general purpose of the present invention, which will be described subsequently in greater detail, is to provide a new invisible fence rechargeable battery assembly which has many of the advantages of the battery packs mentioned heretofore and many novel features that result in a new invisible fence rechargeable battery assembly which is not anticipated, rendered obvious, suggested, or even implied by any of the prior art battery packs, either alone or in any combination thereof. The present invention includes a battery holder assembly including a battery holder having an open end and a closed end and also includes a battery pack being removably disposed in the battery holder and including a battery, and also including contacts being in communication with the battery, and a circuit module being in communication with the battery and at least one of the contacts, wherein the battery pack includes battery terminals. None of the prior art includes the combination of the elements of the present invention.

There has thus been outlined, rather broadly, the more important features of the invisible fence rechargeable battery assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new invisible fence rechargeable battery assembly which has many of the advantages of the battery packs mentioned heretofore and many novel features that result in a new invisible fence rechargeable battery assembly which is not anticipated, rendered obvious, suggested, or even implied by any of the prior art battery packs, either alone or in any combination thereof.

Still another object of the present invention is to provide a new invisible fence rechargeable battery assembly for dramatically reducing homeowner's yearly invisible fence operating costs and reducing disposal of non-rechargeable batteries.

Still yet another object of the present invention is to provide a new invisible fence rechargeable battery assembly that is environmentally friendly since several million homes utilize invisible fence systems and millions of invisible fence batteries are thrown away each year.

Even still another object of the present invention is to provide a new invisible fence rechargeable battery assembly that is compact, convenient and easy to use to recharge invisible fence batteries used to confine pets such as dogs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
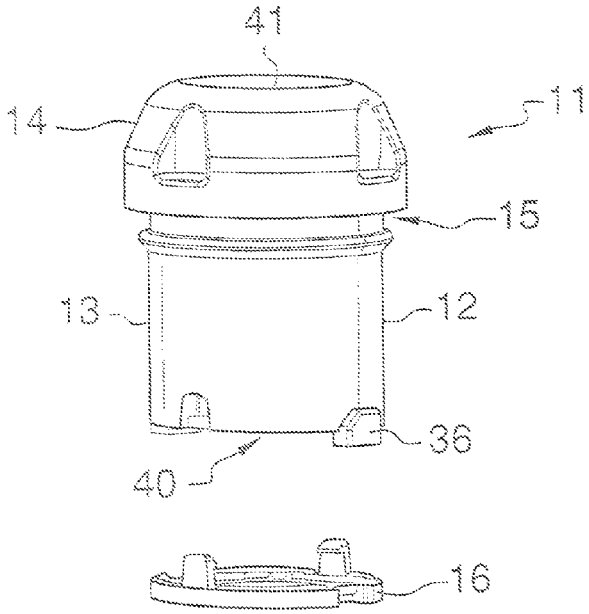
FIG. 1 is an exploded perspective view of a new invisible fence rechargeable battery assembly according to the present invention and showing the battery holder.
Figure 2:
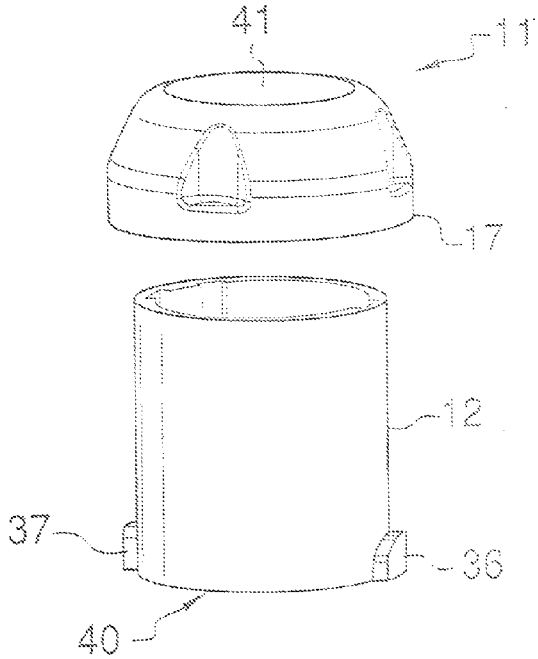
FIG. 2 is an exploded top perspective view of the present invention showing a second embodiment of the battery holder.
Figure 3:
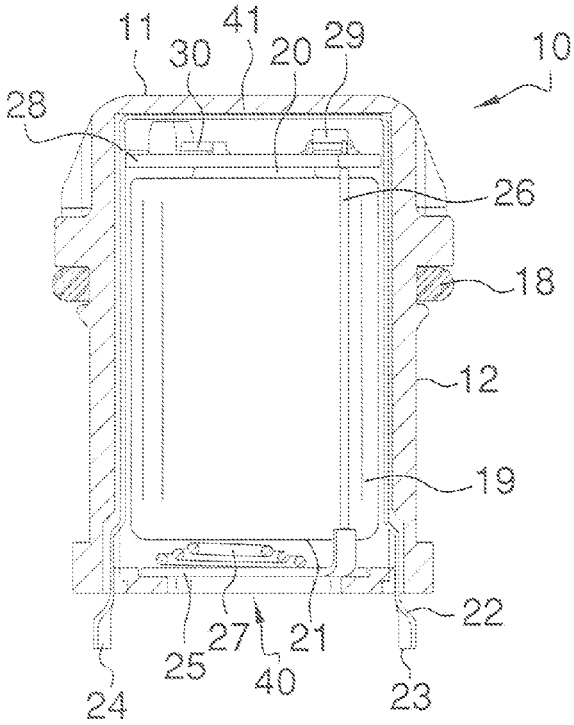
FIG. 3 is a side cross-sectional view, of the battery holder showing the battery pack.

With reference now to the drawings, and in particular to FIGS. 1 through 7 thereof, a new invisible fence rechargeable battery assembly embodying the principles and concepts of the present invention and generally designated by the reference numeral 10 will be described.

As best illustrated in FIGS. 1 through 7, the invisible fence rechargeable battery assembly 10 generally comprises a battery holder assembly including a battery holder 11 having an open end 40 and a closed end 41, and also comprises a battery pack being removably disposed in the battery holder 11 and including a battery 19, and also including contacts being in communication with the battery 19, and a circuit module 28 being in communication with the battery 19 and at least one of the contacts, wherein the battery pack includes battery positive and negative terminals 20,21.

As one embodiment, the battery holder 11 includes a housing 12 having a main portion 13, a cap portion 14 forming the closed end 41 of the battery holder 11, and a cover 16 being removably attached at the open end 40 of the battery holder 11, and further includes lugs 36,37 being conventionally disposed upon the main portion 13. The cover 16 is generally a ring having opposed clip members integrally extending outwardly from the ring. The main portion 13 is cylindrical shaped and has opposed notches disposed in the side of the main portion 13 near an end thereof. The cover 16 is fastened to the main portion 13 with the clip members being received in the notches. However, the cover 16 could also be attached to the main portion 13 by any suitable means including welding or using adhesives. The housing 12 also includes a channel-shaped receptacle 15 disposed about a circumference of the main portion 13. The battery holder assembly also includes a seal member 18 such as an O-ring being disposed in the receptacle 15 to facilitate retaining of the battery holder 11 in an invisible fence electronic device.

As another embodiment, the battery holder 11 includes a housing 12 and also includes a cap member 17 being conventionally attached or connected to the housing 12 and further includes lugs 36,37 being conventionally disposed upon the housing 12. The battery holder assembly also includes a seal member 18 such as an O-ring being disposed about the housing 12 to facilitate retaining of the battery holder 11 in an invisible fence electronic device.

The contacts includes a battery negative contact 25 which is either generally a planar member being conventionally supported by the battery holder 11 and being disposed at the open end 40 of the battery holder 11. The contacts also includes a battery positive contact 22 which is a conductive strip also being conventionally supported inside the battery holder 11 and being disposed about the battery 19 and having at least one end portion 23,24 extending from the open end 40 of the battery holder 11 and being in communication with the circuit module 28. The circuit module 28 such as a circuit board is conventionally attached to the battery positive contact 22 and to the battery holder 11 and is in communication and contactable relationship with at least one of the battery terminals 20,21, in particular, to the positive terminal 20 and is disposed in the battery holder 11 at the closed end 41 thereof between the battery 19 and the battery holder 11 and also includes means including a microcontroller 29 or even a battery IC for protecting against over discharge, short circuit and over charge and the circuit module 28 further includes a battery status indicator 30 which is a light emitting diode. The battery pack further includes a biased element 27 such as a spring being engagably disposed between the battery negative contact 25 and the battery 19. The spring biasedly urges the battery 19 into contact with the circuit module 28. The battery pack also includes an electrical conductive element 26 such as a wire being conventionally attached to and interconnecting the battery negative contact 25 to the circuit module 28 to energize the circuit module 28.

As a second embodiment, the battery pack further includes charging poles 33,34 being in communication with and conventionally connected to the circuit module 28 and extending from the battery holder 11 through openings in the closed end 41 for charging the battery 19 without having to remove the battery pack assembly from an invisible fence electronic device.

Figure 5:
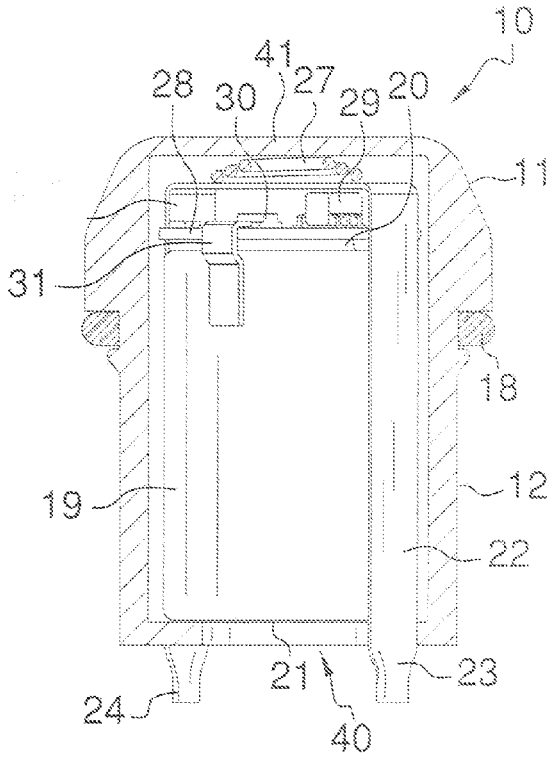
FIG. 5 is a side cross-sectional view of the battery holder showing a third embodiment of the battery pack.
Figure 4:
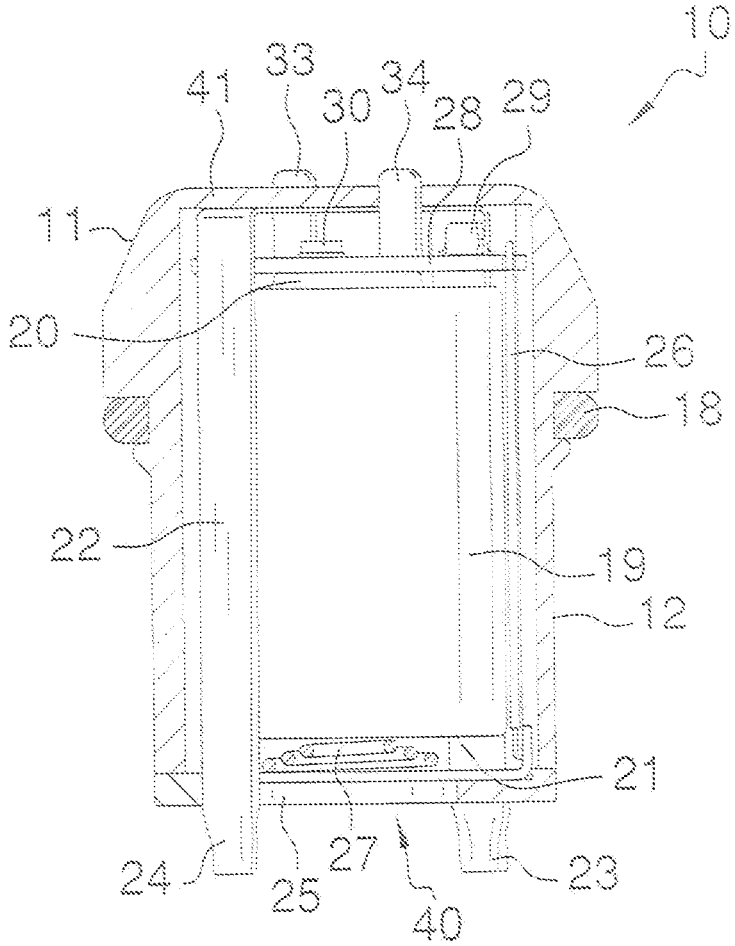
FIG. 4 is a side cross-sectional view of the battery holder showing a second embodiment of the battery pack.

As a third embodiment, the battery pack further includes a biased element 27 being conventionally disposed in the battery holder 11 at the closed end 41 thereof. The biased element 27 is biasedly engaged to the closed end 41 of the battery holder 11 and to the battery positive contact 22 and urges the circuit module 28, which is in contact with the battery positive contact 22, into contact with the battery 19. The battery pack also includes a circuit module negative contact 31 which is in contact with the circuit module 28 and the battery 19. The battery negative contact for this embodiment is also the battery negative terminal 21 as shown in FIG. 5

Figure 6:
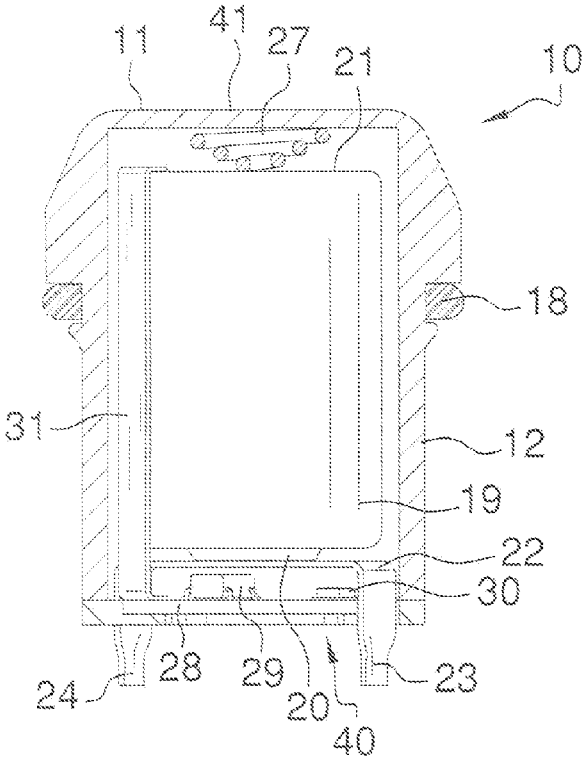
FIG. 6 is a side cross-sectional view of the battery holder showing a fourth embodiment of the battery pack.

As a fourth embodiment, the circuit module 28 such as a circuit board is in communication with at least one of the battery terminals 20,21, in particular, the positive terminal 20 and is conventionally supported in the battery holder 11 at the open end 40 thereof between the battery 19 and the cover 16 and also includes means such as a microcontroller 29 or battery IC for protecting against over discharge, short circuit and over charge with the circuit module 28 also including a battery status indicator 30. The battery negative contact for this embodiment is the circuit module 28 as shown in FIG. 6. The contacts include a battery positive contact 22 being conventionally disposed and supported by the battery holder 11 at the open end 40 thereof. The battery positive contact 22 has at least one end portion 23,24 extending from the open end 40 of the battery holder 11, and the battery positive contact 22 is in contactable relationship with the circuit module 28. The battery pack further includes a biased element 27 such as a spring being conventionally disposed between the closed end 41 of the battery holder 11 and the battery 19 and urging the battery 19 into contact with one of the contacts, in particular, the battery positive contact 22. The battery pack also includes a circuit module negative contact 31 being in conventional contact with the circuit module 28 and a negative terminal 21 of the battery 19 to energize the circuit module 28.

Figure 7:
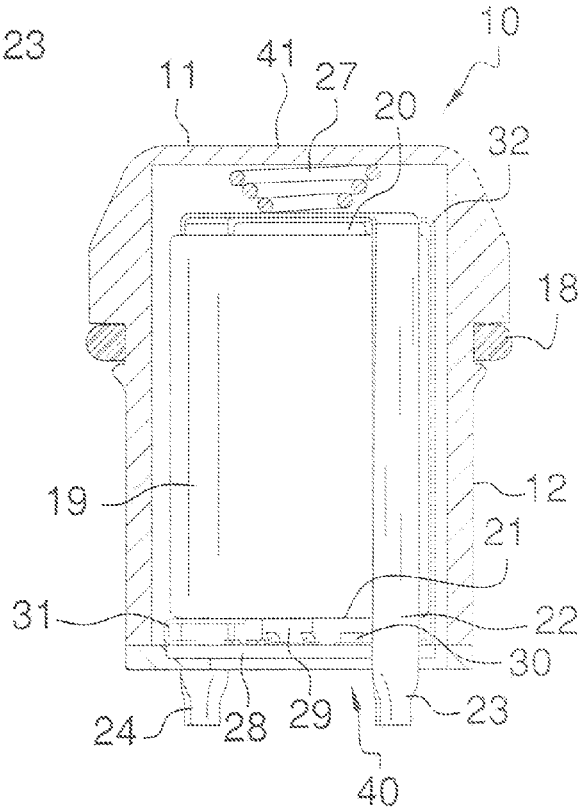
FIG. 7 is a side cross-sectional view of the battery holder showing a fifth embodiment of the battery pack.

As a fifth embodiment, the contacts include a battery positive contact 22 such as a conductible strip being conventionally disposed about the battery 19 and having at least one end portion 23,24 extending from the open end 40 of the battery holder 11. The battery pack also includes a circuit module negative contact 31 being in contact with the circuit module 28 and a negative terminal 21 of the battery 19 to energize the circuit module 28. The circuit module negative contact 31 is conventionally disposed at the open end 40 of the battery holder 11 and is conventionally supported by the battery 19 and the battery holder 11. The battery negative contact for this embodiment is the circuit module 28 as shown in FIG. 7. The battery pack further includes a circuit module positive contact 32 being in conventional contact with the circuit module 28 and a positive terminal 20 of the battery 19 to energize the circuit module 28.

In use, the battery assembly can be inserted into either an invisible fence electronic device which is essentially an electronic collar which is fitted about the neck of a dog or in a battery charger designed to recharge the battery 19. The extended or cantilevered portion of the battery positive contact 22 of the battery pack would come into contact with positive contact of the electronic device either for recharging the battery 19 or for energizing the particular electronic device, and the battery negative contact 25 would also come into contact with the electronic device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invisible fence rechargeable battery assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An invisible barrier rechargeable battery assembly comprising:

a battery holder assembly including a battery holder having an open end and a closed end and including a housing, wherein said housing also includes a receptacle about a circumference of said main portion, said battery holder assembly also including a seal member disposed in said receptacle to facilitate retaining of said battery holder in an electronic device; and a battery pack being removably disposed in said battery holder and including a battery, and also including contacts being in communication with said battery, and a circuit module being in communication with said battery and at least one of said contacts, wherein said battery pack includes battery terminals.

2. An invisible barrier rechargeable battery assembly comprising:

a battery holder assembly including a battery holder having an open end and a closed end and including a housing, wherein said battery holder assembly also includes a seal member disposed about said housing to facilitate retaining of said battery holder in an electronic device; and a battery pack being removably disposed in said battery holder and including a battery, and also including contacts being in communication with said battery, and a circuit module being in communication with said battery and at least one of said contacts, wherein said battery pack includes battery terminals.

3. An invisible barrier rechargeable battery assembly comprising:

a battery holder assembly including a battery holder having an open end and a closed end;

a battery pack being removably disposed in said battery holder and including a battery, and also including contacts being in communication with said battery, and a circuit module being in communication with said battery and at least one of said contacts, wherein said battery pack includes battery terminals, wherein said circuit module such as a circuit board is in communication with at least one of said battery terminals and is disposed in said battery holder at said closed end thereof between said battery and said battery holder and also includes means for protecting against over discharge, short circuit and over charge.

4. The invisible barrier rechargeable battery assembly as described in claim 3, wherein said contacts include a battery negative contact being disposed at said open end of said battery holder and also include a battery positive contact being disposed about said battery and having at least one end portion extending from said open end of said battery holder and being in communication with said circuit module.

5. The invisible barrier rechargeable battery assembly as described in claim 4, wherein said battery pack further includes a biased element being disposed between said battery negative contact and said battery and urging said battery into contact with said circuit module.

6. The invisible barrier rechargeable battery assembly as described in claim 4, wherein said battery pack also includes an electrical conductive element interconnecting said battery negative contact to said circuit module, said battery positive contact being connected with said circuit module.

7. The invisible barrier rechargeable battery assembly as described in claim 4, wherein said battery pack further includes charging poles being in communication with said circuit module and extending from said battery holder through said closed end for charging said battery without having to remove the battery pack assembly from an electronic device.

8. The invisible barrier rechargeable battery assembly as described in claim 3, wherein said contacts include a battery negative contact which is one of said battery terminals and also include a battery positive contact being disposed about said battery and having at least one end portion extending from said open end of said battery holder and being in communication with said circuit module.

9. The invisible barrier rechargeable battery assembly as described in claim 8, wherein said battery pack further includes a biased element being disposed in said battery holder at said closed end thereof.

10. The invisible barrier rechargeable battery assembly as described in claim 9, wherein said biased element is biasedly engaged to said closed end of said battery holder and to said battery positive contact and urges said circuit module, which is in contact with said battery positive contact, into contact with said battery.

11. The invisible barrier rechargeable battery assembly as described in claim 3, wherein said battery pack also includes a circuit module negative contact which is in contact with said circuit module and said battery.

12. An invisible barrier rechargeable battery assembly comprising:

a battery holder assembly including a battery holder having an open end and a closed end;

a battery pack being removably disposed in said battery holder and including a battery, and also including contacts being in communication with said battery, and a circuit module being in communication with said battery and at least one of said contacts, wherein said battery pack includes battery terminals, wherein said circuit module such as a circuit board is in communication with at least one of said battery terminals and is disposed in said battery holder at said open end thereof adjacent to said battery and supported by said battery holder and also includes means for protecting against over discharge, short circuit and over charge.

13. The invisible barrier rechargeable battery assembly as described in claim 12, wherein said contacts include a battery positive contact being disposed at said open end of said battery holder, said battery positive contact having at least one end portion extending from said open end of said battery holder, and said battery positive contact being in contact with said circuit module, said circuit module also being a battery negative contact.

14. The invisible barrier rechargeable battery assembly as described in claim 13, wherein said battery pack further includes a biased element being disposed between said closed end of said battery holder and said battery and urging said battery into contact with one of said contacts.

15. The invisible barrier rechargeable battery assembly as described in claim 12, wherein said battery pack also includes a circuit module negative contact being in contact with said circuit module and a negative terminal of said battery to energize said circuit module.

16. The invisible barrier rechargeable battery assembly as described in claim 12, wherein said contacts include a battery positive contact being disposed about said battery and having at least one end portion extending from said open end of said battery holder, said contacts also including a battery negative contact which is said circuit module.

17. The invisible barrier rechargeable battery assembly as described in claim 16, wherein said battery pack further includes a biased element being disposed between said closed end of said battery holder and one of said contacts.

18. The invisible barrier rechargeable battery assembly as described in claim 16, wherein said battery pack also includes a circuit module negative contact being in contact with said circuit module and a negative terminal of said battery to energize said circuit module.

19. The invisible barrier rechargeable battery assembly as described in claim 16, wherein said battery pack further includes a circuit module positive contact being in contact with said circuit module and a positive terminal of said battery to energize said circuit module.

* * * * *